United States Patent [19]

Raine et al.

[11] Patent Number: 5,005,880

[45] Date of Patent: Apr. 9, 1991

[54] SELF-SEALING SNAP-IN RECEPTACLE, ESPECIALLY FOR CIRCUIT BREAKER COVER RETENTION

[75] Inventors: Peter D. Raine, Palo; Darrell P. Ophaug, Marion, both of Iowa

[73] Assignee: Square D Company, Palatine, Ill.

[21] Appl. No.: 404,489

[22] Filed: Aug. 31, 1989

[51] Int. Cl.[5] ..... E05C 19/06

[52] U.S. Cl. ..... 292/17; 292/DIG. 38

[58] Field of Search ..... 292/17, DIG. 38, 19, 292/18, 14, 80, 87, 76, 70

[56] References Cited

U.S. PATENT DOCUMENTS

| | | | |
|---|---|---|---|
| 2,414,662 | 1/1947 | Ostrom | 292/17 |
| 2,803,865 | 8/1957 | Eljonian et al. | 292/70 X |
| 3,103,378 | 9/1963 | Ahlgren | 292/17 |
| 3,235,299 | 2/1966 | Kobryner | 292/17 |
| 4,250,599 | 2/1981 | Nagashima et al. | 292/17 X |
| 4,881,764 | 11/1989 | Takahashi et al. | 292/17 X |

FOREIGN PATENT DOCUMENTS

| | | | |
|---|---|---|---|
| 872129 | 6/1971 | Canada | 292/17 |

*Primary Examiner*—Richard E. Moore

*Attorney, Agent, or Firm*—Larry I. Golden; Jose W. Jimenez

[57] ABSTRACT

A receptacle is provided which snaps into and seals an opening in a circuit breaker case. A pair of opposed, resilient tabs hold the receptacle within the opening, and substantially prevent withdrawal of the receptacle from the opening. A pair of resilient legs form a flexible U-shaped notch which is adapted to receive and hold a male member attached to a circuit breaker access cover. Therefore screws are not needed for securing the circuit breaker access cover to the circuit breaker case, and the cover is easily removed and replaced any number of times without the use of special tools.

29 Claims, 2 Drawing Sheets

SELF-SEALING SNAP-IN RECEPTACLE, ESPECIALLY FOR CIRCUIT BREAKER COVER RETENTION

TECHNICAL FIELD

This invention relates generally to releasable connectors, and more particularly to a receptacle for attaching a removable cover to a housing.

BACKGROUND ART

In commercial and residential power distribution systems, power is tapped from one or more main power lines and delivered to a building Typically, each building contains several different circuits which receive the delivered power and distribute the power as needed to electrical loads associated with each circuit. Each of these circuits usually contains a protective device which interrupts the power delivered by the circuit when the electrical loads draw more power through the circuit than the circuit was designed to safely handle. Presently, circuit breakers are commonly chosen as the protective device for use in power distribution systems.

Since these circuits typically branch out from the location at which power is delivered to the building, the circuit breakers are centrally situated near this location. The circuit breakers are mounted in a case which encompasses the circuit breakers and any proximate terminals and bare wires associated with the power distribution system. The case is sealed to prevent people and objects from accidentally making contact with the power distribution lines attached to each circuit breaker. Moreover, the circuit breaker cases are supplied with removable access covers so that the circuit breakers may be serviced or replaced.

For safety reasons Underwriters Laboratories prohibits access to internal components when the access cover is in place. Therefore, the access cover is typically screwed into threaded inserts in the case to provide a tight seal between the access cover and the case. While this type of attachment certainly meets the requirements of Underwriters Laboratories, usually a number of screws must be removed in order to detach the cover from the case.

Typically, the access covers and cases are made from an electrically insulating material, such as plastic. This helps prevent an accidental contact of a live wire with the access cover or case from electrifying the access cover or the case. It is also preferable to use fasteners that are made from an insulating material to attach the access cover to the case. But plastic or composite screws can be easily damaged by misthreading and are often brittle.

Accordingly, there is a need for an alternative means for providing a seal in accordance with Underwriters Laboratories' safety requirements, while allowing the access cover to be easily removed from the circuit breaker case.

DISCLOSURE OF INVENTION

In accordance with the present invention, an assembly for connecting a cover to a plate includes a male member which is attached to the cover and which extends outwardly therefrom. The plate has a predefined opening therein. A receptacle is adapted to attach itself within the predefined opening and to receive and hold the male member. The attachment of the male member to the receptacle brings the cover into contact with the plate, and thereby seals the cover to the plate.

Preferably, the receptacle is made from a unitary piece of resilient material, and includes a base from which two resilient legs extend to form a U-shaped notch therebetween. The U-shaped notch is adapted to accept and hold the male member therein. The receptacle also has a peripheral sealing surface and is formed with tabs that engage flanges formed in the opening in the plate to hold the receptacle in the opening and to engage the peripheral sealing surface with a mating surface in the opening.

BRIEF DESCRIPTION OF DRAWINGS

Other objects and advantages of the invention will become apparent upon reading the following detailed description and upon reference to the drawings in which.

Figure 1:
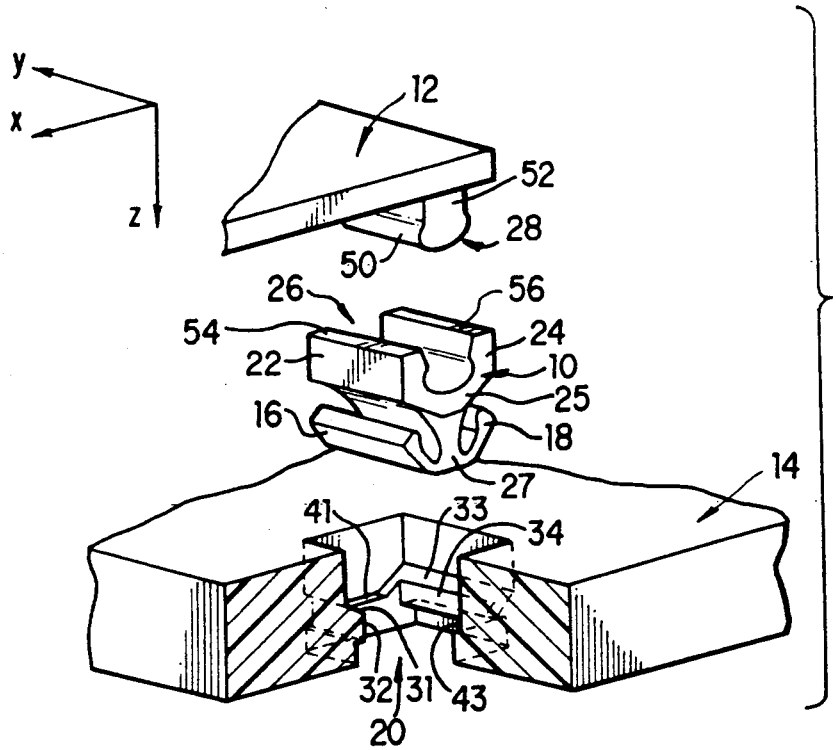
FIG. 1 illustrates a perspective, exploded view of a portion of a circuit breaker cover and case with a snap-in receptacle in accordance with the present invention.

While the invention is susceptible to various modifications and alternative forms, specific embodiments thereof have been shown by way of example in the drawings and will be described in detail herein. It should be understood, however, that it is not intended to limit the invention to the particular forms disclosed, but on the contrary, the intention is to cover all modifications, equivalents, and alternatives falling within the spirit and scope of the invention as defined by the appended claims.

BEST MODE FOR CARRYING OUT THE INVENTION

Turning now to the drawings and referring initially to FIG. 1, there is shown a snap-in receptacle 10 for attaching a cover 12 such as a circuit breaker access cover to a housing 14 such as a circuit breaker case. The snap-in receptacle 10 is made from a resilient and electrically insulating material such as thermoplastic resin. Moreover, the snap-in receptacle 10 is preferably formed as a one-piece unit by a suitable process, such as injection molding.

The snap-in receptacle 10 includes a pair of opposed, resilient tabs 16, 18 which are used to mount the snap-in receptacle 10 within an opening 20 in the circuit breaker case 14. A corner of the circuit breaker case 14 is shown cut away in FIG. 1 to illustrate the shape of the opening 20.

The snap-in receptacle 10 also includes a pair of opposed, resilient legs 22, 24 which extend from a base 25 and which form a generally U-shaped notch 26 therebetween. The U-shaped notch 26 is sized to receive a male member 28 which is attached to or molded into one side of the circuit breaker access cover 12. The circuit breaker access cover 12, for example, is preferably made of thermoplastic resin in contrast to the circuit breaker case 14 which is preferably made of thermosetting resin. The tabs 16, 18 of the receptacle 10 are attached to the base 25 by a shank 27.

FIGS. 2 through 5 generally illustrate an assembly procedure used for mounting the snap-in receptacle 10 into the opening 20, and attaching the circuit breaker access cover 12 into sealing engagement with the circuit breaker case 14. For the sake of clarity, the circuit breaker case 14 is shown as a cross-sectional view taken generally along the x-axis of FIG. 1.

Figure 2:
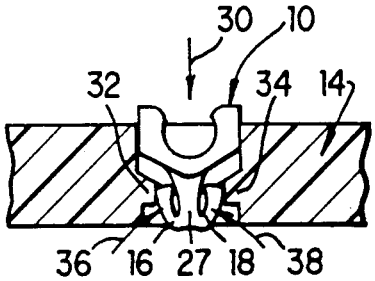
FIG. 2 is a cross-sectional view of the snap-in receptacle and the circuit breaker case during insertion of the receptacle into an opening in the circuit breaker case.

FIG. 2 shows the snap-in receptacle 10 being inserted into the opening in the case 14. The snap-in receptacle 10 is inserted generally in the direction of arrow 30. The opening includes two opposed flanges 32, 34 which protrude into the opening and narrow the dimension of the opening along the x-axis. When the opposed resilient tabs 16, 18 on the snap-in receptacle 10 contact the flanges 32, 34, the tabs 16, 18 are bent in the directions of arrows 36, 38. Since the tabs 16, 18 are resilient, the snap-in receptacle 10 may continue to move into the opening 20 by virtue of force which is applied in the direction of arrow 30.

Figure 3:
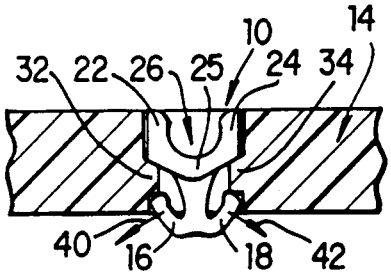
FIG. 3 is a cross-sectional view of the snap-in receptacle when fully inserted into the opening in the circuit breaker case.

As shown in FIG. 3, the snap-in receptacle 10 comes to rest when the base 25 of the receptacle contacts the flanges 32, 34. The length of the shank 27 is such that, upon contact of the base 25 with the flanges 32, 34, the tabs 16, 18 flex outwardly generally in the directions of arrows 40, 42 to return to their original positions. In their original positions, the tabs 16, 18 extend outwardly within the opening 20 so that the snap-in receptacle 10 is locked into the opening 20.

The configuration of the snap-in receptacle 10 and the opening 20 are such that the receptacle seals the opening 20 to prevent any foreign objects from entering the circuit breaker case 14 once the receptacle is in place. To provide a secure seal between the snap-in receptacle 10 and the circuit breaker case 14, the opening 20 is formed with ledges 41, 43 (see FIG. 1) and respective surfaces 31, 33 (see FIG. 1) above the flanges 32, 34. In particular the dimension along the y-axis of the shank 27 of the receptacle 10 is narrower than the dimension along the y-axis of its base 25, so that the periphery of the base 25 seats against the ledges 41, 43 and surfaces 31, 33. A tight seal occurs because the ends of the tabs 16, 18 of the receptacle are angled and press against the underside of the flanges 32, 34 due to their outward flexing in the direction of the arrows 40, 42 (see FIG. 3), thereby forcing the receptacle downward.

To prevent the snap-in receptacle from being inserted improperly into the opening 20, the dimensions of the snap-in receptacle 10 along the x and y axes (see FIG. 1) are preferably different. Accordingly the dimensions of the opening 20 along the x and y axes are also different to accommodate the snap-in receptacle 10. Therefore, the snap-in receptacle 10 and the opening 20 take on a complementary and generally rectangular shape which readily conveys the proper orientation of the receptacle 10 with respect to the opening 20.

To attach the circuit breaker access cover 12 to the circuit breaker case 14, the male member 28 of the circuit breaker access cover 12 is pressed in the direction of arrow 44 into the U-shaped notch (26 in FIG. 1). There is a slight clearance between the sides of the opening 20 and the legs 22, 24, (see FIG. 3) so that the legs are allowed to flex apart, generally in the direction of arrows 46, 48 (see FIG. 4), in response to insertion of the male member 28.

Figure 4:
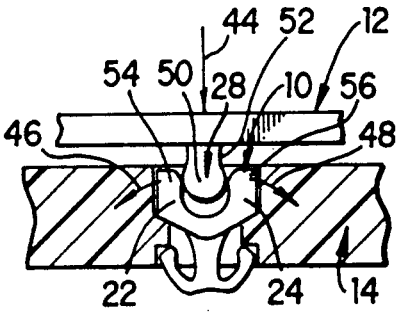
FIG. 4 is a cross-sectional view of the circuit breaker case during insertion of a male member on the circuit breaker cover into the snap-in receptacle.

As shown in FIG. 4, the male member 28 includes a rounded end portion 50 that is connected to the circuit breaker access cover 12 by a neck 52, which is thinner than the rounded end portion 50 along the x-axis. Each of the legs 22, 24 includes a terminal end portion 54, 56 which narrows the U-shaped notch 26 along the x-axis. As the rounded end portion 50 of the male member 28 is pressed into the U-shaped notch 26, the rounded end portion 50 contacts the terminal end portions 54, 56 of the legs 22, 24, thus forcing the legs 22, 24 apart.

Figure 5:
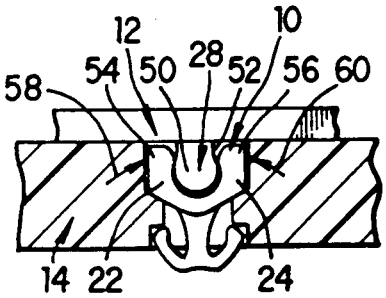
FIG. 5 is a cross-sectional view of the circuit breaker case having the circuit breaker cover fully inserted into the snap-in receptacle.

Continued pressure in the direction of arrow 44 causes the rounded end portion 50 to push past the terminal end portions 54, 56 so that the legs 22, 24 return to their original positions, as shown by the arrows 58, 60 in FIG. 5. The rounded end portion 50 of the male member 28 is held securely within the U-shaped notch 26 because the terminal end portions 54, 56 of the legs 22, 24 encompass the rounded end portion 50 and contact the neck 52.

It should also be noted that there is substantially no clearance between the access cover 12 and the case 14 when the cover 12 is attached to the case 14. Therefore, it is difficult for any foreign objects to enter into the case 14 between the case 14 and the cover 12.

To remove the circuit breaker access cover 12 from the circuit breaker case 14, a prying instrument, such as a flat bladed screwdriver, is inserted between the cover 12 and the case 14. The prying instrument (not shown) is used as a lever to force the cover 12 away from the case 14. Since the tabs 16, 18 securely hold the snap-in receptacle 10 within the opening 20, the prying force forces the male member 28 out of the U-shaped notch 26. The extraction of the male member 28 from the U-shaped notch 26 generally follows the steps of the attachment procedure in reverse order.

Figure 6:
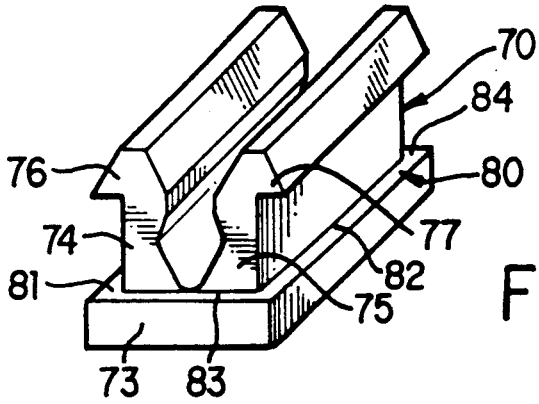
FIG. 6 is a perspective view of an alternative construction for a snap-in receptacle in accordance with the present invention.
Figure 7:
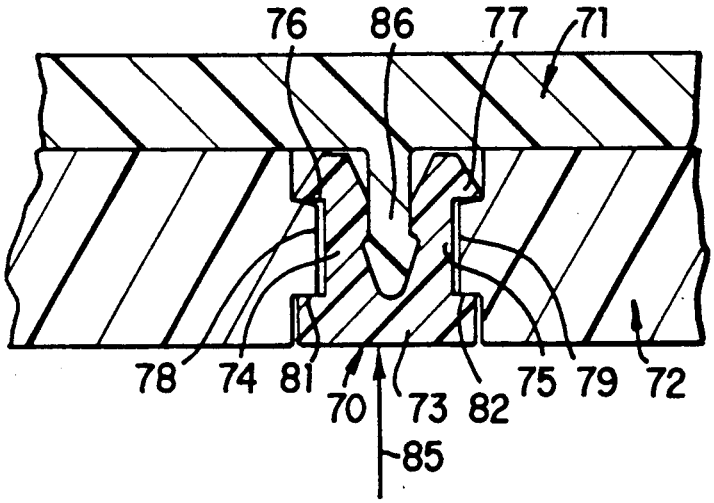
FIG. 7 is a cross-sectional view showing a circuit breaker cover fastened to a circuit breaker case using the alternative receptacle of FIG. 6.

Turning now to FIGS. 6 and 7, there is shown an alternative receptacle generally designated 70 being used for securing a circuit breaker access cover 71 to a circuit breaker case 72. The receptacle 70 includes a base 73 from which two resilient legs 74 and 75 extend to form a U-shaped notch therebetween. The upper end portions of the legs are formed with respective outwardly extending tabs 76 and 77.

As shown in FIG. 7, the receptacle 70 is locked into a rectangular opening in the case 72. The opening is formed with two opposed flanges 78, 79 which compress the tabs 76 and 77 together when the receptacle is initially inserted into the opening in the direction of arrow 85. Once the receptacle 70 is fully inserted, the tabs 76 and 77 spring apart to engage with upper ledges of the flanges 78 and 79. In addition, the base 73 extends outward from the legs 74 and 75 in both a direction parallel and perpendicular to an axis aligned with the U-shaped notch, to thereby form an upper peripheral ledge generally designated 80 (FIG. 6) which has a portion 81 sealing against a lower surface of the flange 78, and a portion 82 sealing against the lower portion of the flange 79. In a similar fashion the peripheral surface 80 has a portion 83 (see FIG. 6) that seals against an overhanging internal surface (not shown) of the case 72, and a surface 84 (see FIG. 6) that mates with another overhanging internal surface of the case 72. In this fashion, the peripheral surface 80 of the receptacle 70 is sealed against a continuous internal overhanging surface of the case 72 to thereby completely seal the opening in the case.

Once the receptacle 70 is inserted into the opening of the case 72, the cover 71 can be secured to the case 72 by insertion of a male member 86 that is attached or integrally formed in the cover 71. To permit the male member 86 to be inserted and removed any number of times into the receptacle 70, the receptacle 70 is formed of an electrically insulating and resilient material such as thermoplastic resin, and the distance between the outward surfaces of the legs 74 and 75 when the male member is either fully removed or fully inserted is slightly less than the distance between the opposing surfaces of the flanges 78 and 79 to provide the clearance shown in FIG. 7. Therefore, the legs 74 and 75 are allowed to slightly spread apart when the male member 86 is being inserted or extracted.

Although the cover 12 illustrated in FIG. 1 and the cover 71 illustrated in FIG. 7 have been shown with just a single male member 28 or 86, respectivelY, it should be appreciated that each access cover is preferably formed with a plurality of male members at respective end portions of the access cover. For small covers, for example, each cover would be molded with two male members, at opposite end portions of the cover. These two male members would mate with respective receptacles placed in openings in corresponding locations in the circuit breaker case. For large access covers, each cover could be molded with four male members, one at each of four corners of the cover.

In view of the above, there has been provided a unitary receptacle for connecting a cover to a plate. The receptacle is locked into an opening in the plate and engages a male member attached to the cover. The receptacle is formed for sealing the opening and is resilient for engaging and disengaging the male member of the cover any number of times. Therefore, the assembly can seal a circuit breaker case while allowing an access cover to be easily assembled or removed without use of special tools.

I claim:

1. A one-piece fastener for fastening a cover to a plate, said fastener comprising:

a base from which two resilient legs extend to form a U-shaped notch therebetween, said notch being formed to engage a male member attached to said cover, means defining a peripheral sealing surface around said base, and means including a pair of protruding tabs for engaging respective opposing ledges in an opening defined by a perimeter in said plate to hold said peripheral sealing surface against a mating surface in said plate so that said receptacle is locked in said opening and seals said opening around substantially the entire perimeter.

2. The fastener as claimed in claim 1, further comprising a shank extending from said base in a direction opposite from said legs, and wherein said tabs extend outwardly from said shank.

3. The fastener as claimed in claim 2, wherein said peripheral sealing surface is a surface of said base, and said legs protrude from a surface of said base opposite from said peripheral sealing surface.

4. The fastener as claimed in claim 1, wherein said tabs protrude outward in opposite directions from the end portions of respective ones of said resilient legs.

5. The fastener as claimed in claim 4, wherein said peripheral sealing surface is a surface of said base and said legs protrude from the peripheral sealing surface.

6. The fastener as claimed in claim 1, wherein said base has a length along a perpendicular axis of said U-shape and a width substantially less than said length.

7. The fastener as claimed in claim 6, wherein said base is rectangular.

8. A one-piece fastener for fastening a cover to a plate, said fastener comprising:

a base from which two resilient legs extend to form a U-shaped notch therebetween, said notch being formed to engage a male member attached to said cover, means including a pair of tabs which extend outward in opposite directions for engaging respective opposing ledges in an opening in said plate to engage respective ones of said ledges between said base and respective ones of said tabs to thereby lock said receptacle in said opening in said plate, and a shank extending from said base in a direction opposite from said legs, wherein said tabs extend outwardly from said shank, and wherein said base is formed with a peripheral sealing surface around said shank.

9. The fastener as claimed in claim 8, wherein said tabs protrude outward in opposite directions from end portions of respective ones of said resilient legs.

10. The fastener as claimed in claim 9, wherein said base is formed with a peripheral sealing surface around said legs.

11. The fastener as claimed in claim 8, wherein said base has a length along a perpendicular axis of said U-shape and a width substantially less than said length.

12. The fastener as claimed in claim 11, wherein said base is rectangular.

13. The fastener as claimed in claim 8, consisting of thermoplastic resin.

14. An assembly comprising, in combination:

a plate;

a cover;

a male member being attached to one of said cover and said plate and extending outwardly therefrom, the other of said cover and said plate having a predefined opening therein; and a unitary receptacle, separate from said other of said cover and said plate, formed with means for attaching itself within said predefined opening and means for receiving and holding said male member, wherein engagement of said male member in said receptacle brings said cover into contact with said plate, thereby sealing said cover to said plate.

15. The assembly as claimed in claim 14, wherein said means for receiving and holding said comprises a base from which two resilient legs extend to form a U-shaped notch therebetween, said notch being formed to engage said male member.

16. The assembly as claimed in claim 15, wherein said other of said cover and plate is formed with opposing ledges at opposite sides of said opening, and said means for attaching itself includes a pair of tabs which extend outward in opposite directions for engaging respective ones of said opposing ledges to thereby lock said receptacle in said opening.

17. The assembly as claimed in claim 16, wherein said receptacle further comprises a shank extending from said base in a direction opposite from said legs, and wherein said tabs extend, outwardly from said shank.

18. The assembly as claimed in claim 17, wherein said base is formed with a peripheral sealing surface around said shank, and wherein said other of said cover and plate is formed with a surface around said opening which mates with said peripheral sealing surface so that said receptacle seals said opening when said receptacle is locked in said opening.

19. The assembly as claimed in claim 16, wherein said tabs protrude outward in opposite directions from end portions of respective ones of said resilient legs.

20. The assembly as claimed in claim 15, wherein said base is formed with a peripheral sealing surface around said legs, and wherein said other of said cover and plate is formed with a surface around said opening which mates with said peripheral sealing surface so that said receptacle seals said opening when said receptacle is locked in said opening.

21. The assembly as claimed in claim 14, wherein said opening is rectangular and has a length and a width substantially less than said length, and wherein said receptacle has a corresponding rectangular shape.

22. The assembly as claimed in claim 14, wherein said receptacle consists of thermoplastic resin.

23. An assembly comprising, in combination:

a unitary plate formed with at least one protruding male member;

a cover having an opening aligned with said protruding male member;

a receptacle formed with means for attaching itself within said opening and means for receiving and holding said male member, wherein engagement of said male member in said receptacle brings said cover into contact with said plate, thereby sealing said cover to said plate;

wherein said means for receiving and holding said male member comprises a base from which two resilient legs extend to form a U-shaped notch therebetween, said notch being formed to engage said male member; and wherein said plate is formed with opposing ledges at opposite sides of said opening, and said means for attaching itself includes a pair of tabs which extend outward in opposite directions for engaging respective ones of said opposing ledges to thereby lock said receptacle in said opening.

24. The assembly as claimed in claim 23, wherein said receptacle further comprises a shank extending from said base in a direction opposite from said legs, and wherein said tabs extend outwardly from said shank.

25. The assembly as claimed in claim 24, wherein said base is formed with a peripheral sealing surface around said shank, and wherein said other of said cover and plate is formed with a surface around said opening which mates with said peripheral sealing surface so that said receptacle seals said opening when said receptacle is locked in said opening.

26. The assembly as claimed in claim 23, wherein said tabs protrude outward in opposite directions from end portions of respective ones of said resilient legs.

27. The assembly as claimed in claim 23, wherein said base is formed with a peripheral sealing surface around said legs, and wherein said other of said cover and plate is formed with a surface around said opening which mates with said peripheral sealing surface so that said receptacle seals said opening when said receptacle is locked in said opening.

28. The assembly as claimed in claim 23, wherein said opening is rectangular and has a length and a width substantially less than said length, and wherein said receptacle has a corresponding rectangular shape.

29. The assembly as claimed in claim 23, wherein said receptacle consists of a single piece of thermoplastic resin, said cover consists of thermoplastic resin, and said plate consists of thermosetting resin.

* * * * *